United States Patent [19]

Morse et al.

[11] Patent Number: 4,790,457

[45] Date of Patent: Dec. 13, 1988

[54] SANITARY FOODSTUFF DISPENSER WITH BAFFLE

[76] Inventors: Hugh B. Morse, 680 Wildwood Drive, Watsonville, Calif. 95076; John V. Ciolino, 13558 Paseo Terrano, Salinas, Calif. 93908

[21] Appl. No.: 75,130

[22] Filed: Jul. 20, 1987

Related U.S. Application Data

[63] Continuation-in-part of Ser. No. 941,732, Dec. 15, 1986.

[51] Int. Cl.[4] ..... B67D 5/06

[52] U.S. Cl. ..... 222/185; 222/201; 222/232; 222/449; 222/517; 222/533; 222/556; 222/566; 366/324

[58] Field of Search ..... 222/233, 469, 413, 158, 222/278, 560, 517, 533, 183, 449, 185, 445, 566, 452, 446, 231, 362, 232, 564, 412, 414, 200, 201, 532, 536, 556; 198/550.1, 550.01, 532, 676, 664; 414/310, 326, 319–321; 239/659; 366/313, 324,

[56] References Cited

U.S. PATENT DOCUMENTS

| | | | |
|---|---|---|---|
| 1,186,423 | 6/1916 | Morris | 222/531 X |
| 1,529,379 | 3/1925 | Thompson | 222/413 |
| 2,022,343 | 11/1935 | Drood | 222/536 X |
| 2,059,135 | 10/1936 | Moe | 222/536 X |
| 2,447,409 | 8/1948 | Gulow | 222/531 X |
| 2,532,318 | 12/1950 | Mackey et al. | 198/676 X |
| 2,593,803 | 4/1952 | Schofield | 222/413 X |
| 2,617,273 | 11/1952 | Findlay | 198/676 X |
| 2,633,133 | 3/1953 | Higgins | 222/231 X |
| 2,720,384 | 10/1955 | Gaenzle | 366/324 |
| 3,241,728 | 3/1966 | Murphy | 222/158 X |
| 3,358,886 | 12/1967 | Provenza | 222/158 |
| 3,393,899 | 7/1968 | Wells | 366/324 X |
| 3,637,112 | 1/1972 | Christy | 222/412 X |
| 3,705,644 | 12/1972 | Kawchitch | 198/664 |
| 4,013,196 | 3/1977 | Hines, Jr. | 222/231 X |
| 4,029,237 | 6/1977 | Miconi | 222/412 X |
| 4,085,866 | 4/1978 | Fekl | 222/158 |
| 4,146,323 | 3/1979 | Forward et al. | 366/324 X |
| 4,363,341 | 12/1982 | Powell | 222/201 X |
| 4,364,667 | 12/1982 | Reiner | 198/664 X |
| 4,718,578 | 1/1988 | Radek et al. | 222/108 |

OTHER PUBLICATIONS

IBM Technical Disclosure Bulletin, vol. 19, No. 6, Nov. 1976, "One-Piece Auger".

*Primary Examiner*—Kevin P. Shaver
*Assistant Examiner*—Gregory L. Huson

[57] ABSTRACT

A dispenser for dispensing solid snack foods and the like comprises a closed container defining a chamber adapted to be at least partially filled with a snack food. A measuring cup is mounted on the container for receiving a measured quantity of the snack food. A combined dispensing tray and chute is pivotally mounted on the measuring cup to normally close an open bottom thereof and is moveable to an open position for discharging the measured quantity of foodstuff. An elongated screw conveyor, having flexible blades, is mounted in the container, between the chamber and measuring cup, and is adapted to be manually turned to convey the measured quantity of foodstuff into the measuring cup. A baffle is movably mounted in the chamber and responsive to rotation of the screw conveyor to shake the foodstuff onto the screw conveyor and to prevent clogging and breakage.

9 Claims, 2 Drawing Sheets

IV
IV

SANITARY FOODSTUFF DISPENSER WITH BAFFLE

CROSS-REFERENCE TO RELATED APPLICATION

This application is a continuation-in-part of U.S. patent application Ser. No. 941,732, filed on Dec. 15, 1986 by Hugh B. Morse and John V. Ciolino for Sanitary Foodstuff Dispenser.

TECHNICAL FIELD

This invention relates to a dispenser for foodstuffs and more particularly to a dispenser for snack foods having a rotary screw conveyor.

BACKGROUND ART

The bulk handling of snack foods in health and grocery stores is normally accomplished by the use of open top containers and scoops. In particular, a customer will normally scoop out the desired quantity of a snack food from a container and deposit it into a plastic or paper bag for weighing and price determination purposes. Snack foods of this type may include raisins, other types of dried fruit, malt balls, cookies, mixed nuts, various candies and the like.

Conventional containers of this type are unsanitary since the snack food is exposed to ambient dirt, dust and vermin, and potential customer contamination. Various dispensing apparatus have been proposed to alleviate the problem of sanitation. For example, U.S. Pat. Nos. 2,920,796 and 4,511,067 each disclose a dispenser that utilizes a paddle-wheel type of conveying member for dispensing measured quantities of foodstuffs. U.S. Pat. No. 2,550,248 discloses a dispenser that includes a reciprocal tray for effecting the dispensing function. U.S. Pat. No. 2,593,803 discloses another type of dispenser wherein a screw conveyor shaft is utilized to dispense finely divided products, such as sugar or salt, into a receptacle that is emptied by tipping the dispenser.

Dispensing apparatus of the above type are relatively complex in construction and operation and may give rise to clogging and related problems. Each dispenser is normally constructed to dispense a single type of foodstuff product and is not particularly adapted for dispensing various types of products having particle sizes ranging from sugar to large pieces of dired fruit. Further, many such dispensers fail to provide the customer with continuous visual inspection of the dispensed product and accurate measurement of the quantity of product being dispensed.

SUMMARY OF THE INVENTION

Applicants' pending U.S. patent application Ser. No. 941,732, incorporated herein by reference, has been found to overcome the above, briefly described problems by providing a sanitary foodstuff dispenser that is non-complex, easy to operate, adapted to accurately dispense foodstuffs having a wide range of particle or product size, and that is clog-free. In addition, the dispenser is preferably transparent to permit the consumer to visually note the quantity of product being dispensed.

The present invention is directed to modifications to such dispenser that improve the dispensing operation.

The sanitary foodstuff dispenser of this invention comprises a closed container defining a chamber adapted to be filled with a preselected quantity of dry foodstuff. A measuring cup is mounted on the container for receiving a measured quantity of the foodstuff. An elongated screw conveyor is rotatably mounted in the container to selectively fill the cup with the foodstuff upon rotation of the conveyor. Dispensing means are provided for dispensing the measured quantity of foodstuff from the measuring cup and into a bag. In one aspect of the present invention, a baffle means is movably mounted in the chamber to shake in response to rotation of the screw conveyor to insure proper dispensing and non-clogging of the foodstuff. In another aspect of this invention, the screw conveyor has a plurality of flexible blades thereon to further aid in the feeding function. In still another aspect of this invention, the dispensing means includes a tubular chute pivoted on the container to aid the consumer in bagging the measured quantity of foodstuff.

BRIEF DESCRIPTION OF THE DRAWINGS

Other objects and advantages of this invention will become apparent from the following description and accompanying drawings wherein.

BEST MODE OF CARRYING OUT THE INVENTION

General Description

Figure 1:
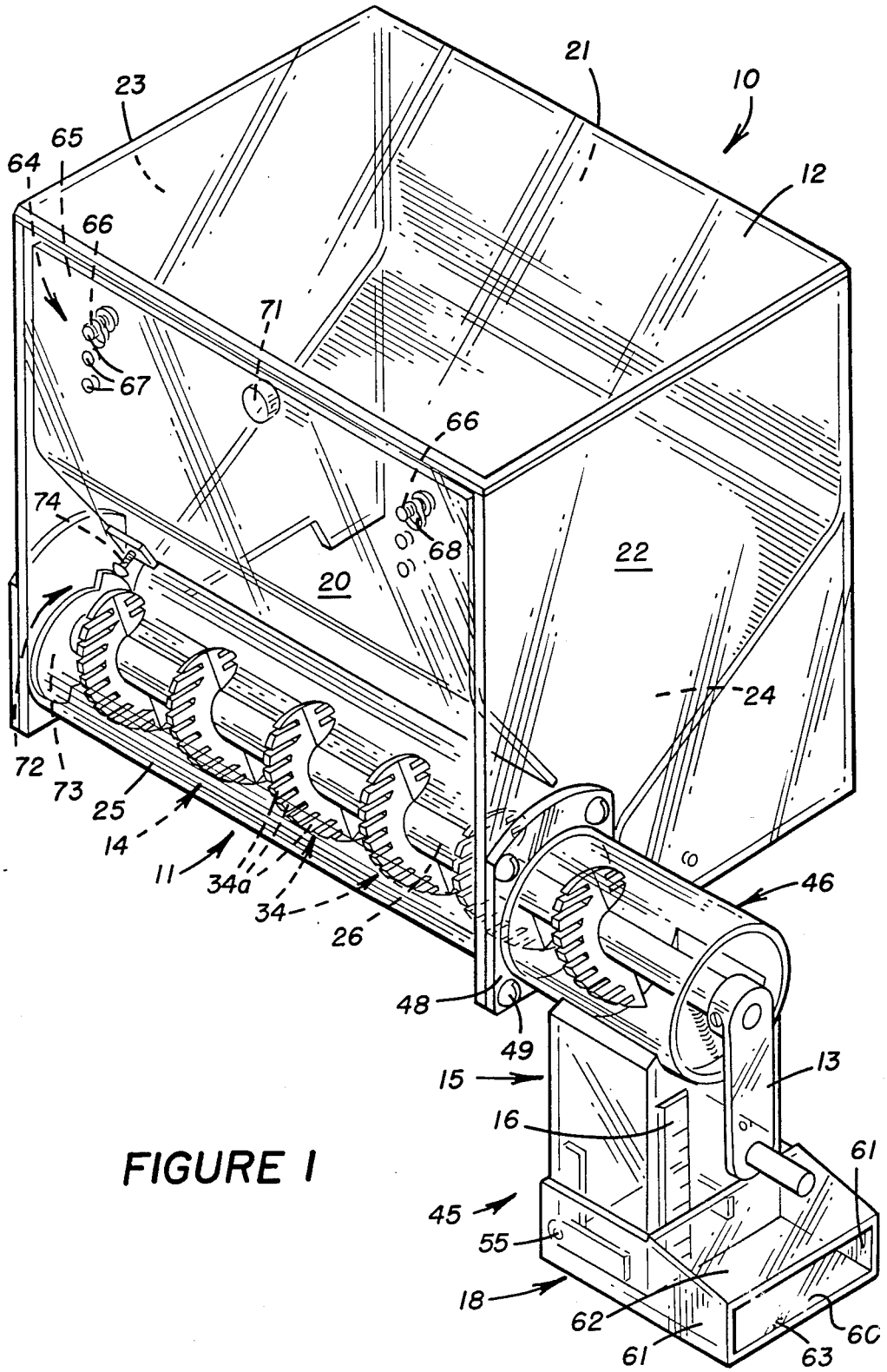
FIG. 1 is a frontal isometric view illustrating a sanitary foodstuff dispenser embodying this invention.

FIG. 1 illustrates a transparent sanitary foodstuff dispenser 10 generally of the type disclosed in Applicants' pending U.S. patent application Ser. No. 941,732. Identical numerals depict corresponding constructions and components.

The dispenser comprises a container 11 having a removable cover 12 suitably mounted thereon. The container defines a closed chamber therein adapted to be at least partially filled with a preselected quantity of dry foodstuff. The foodstuff may comprise any of the standard snack foods sold in health and grocery stores, such as nuts, dried fruit, candies, etc. The dispenser is equally adapted to dispense finer products, such as sugar, flour, coffee and tea.

In use, a customer need only rotate a crank 13 generally clockwise in FIG. 1 a selected number of full or partial turns to rotate a screw conveyor 14 to charge a measuring cup 15 with a measured quantity of the product. Measuring indicia, shown in the form of a marked and graduated tape 16, will visually indicate such measured quantity to the customer. The customer will then rotate a combined tray and chute assembly 18 clockwise in FIG. 2 from its closed position, normally covering an open bottom of cup 15, to its open position 18', illustrated by phantom lines, to dispense the product from the cup and into a bag (not shown).

Detailed Description

Figures 2, 3, 4:
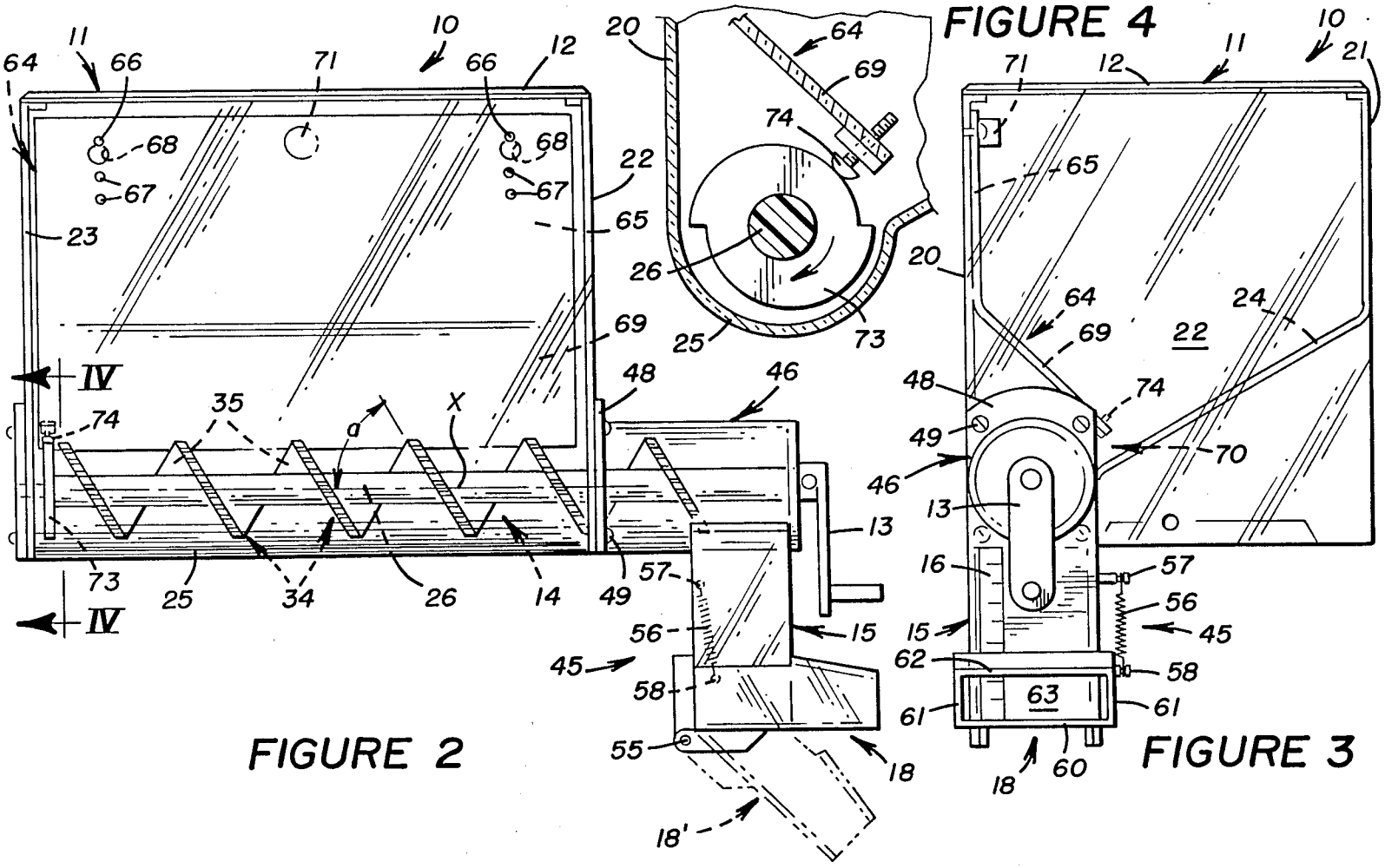
FIG. 2 is a front elevational view of the dispenser.
FIG. 3 is an end elevation view of the dispenser.
FIG. 4 is a sectional view, taken in the direction of arrows IV—IV in FIG. 2.

Referring to FIGS. 1–3, container 11 further comprises upstanding front, back and side walls 20–23, respectively, and a bottom wall 24. The container and other major components of the dispenser are preferably composed of a standard transparent and high impact plastic material. As shown in FIG. 3, bottom wall 24 slopes downwardly from back wall 21 towards front wall 20 and terminates forwardly at an arcuate bottom wall portion 25 underlying screw conveyor 14. The screw conveyor is thus continuously exposed to the product contained in the chamber, defined by the walls of the container. The clearance betwen bottom wall portion 25 and the screw conveyor is pre-designed to accommodate the size of the particular product being transported.

As shown in FIGS. 1 and 2, screw conveyor 14 comprises a shaft 26 rotatably mounted on container 11, as described in Applicants' above-referenced application. The screw conveyor further comprises a plurality of flat, semi-circular and flexible blades 34 secured in longitudinally spaced and parallel relationship on shaft 26. As shown in FIG. 2, each blade is disposed at an acute angle "a", relative to a longitudinal rotational axis X of shaft 26. Such angle is preferably selected from the approximate range of from 45° to 75° and largely depends on the particular type of product being dispensed. The illustrated angle closely approximates 60°.

A triangularly shaped web 35 interconnects the opposed edges of each pair of adjacent blades together on diametrically opposite sides of shaft 26. The webs on each side of shaft 26 are thus disposed in longitudinal alignment with each other and are further aligned and in the same radial plane containing axis X. The split involute configuration of screw conveyor 14 provides that the product will be conveyed gently and without damage or undue binding.

Another advantage of this type of screw conveyor is that it can be injection molded (both shaft 26 and blades 34) in a single operation in contrast to a conventional full involute screw conveyor that cannot be molded in this manner. The screw conveyor is formed from a suitable thermo-plastic or thermo-setting resin molding powder (thermo-plastics are preferred since they are fully polymerized before processing and, during the injection molding process, they undergo a physical change only). For example, a low density polyethylene has been found suitable.

One of the novel aspects of this invention is the formation of each blade 34 with a plurality of flexible fingers **34*a*, extending radially outwardly from shaft 26 in parallel relationship relative to each other (FIG. 1). In one working embodiment of this invention, each blade had a diameter of 3.5 in., a thickness of 0.0625 in. and was composed of low density polyethylene. Fingers 34*a*** were found to exhibit flexing actions that aided in smooth and steady product flow.

Referring to FIGS. 1–3, measuring cup 15 and tray and chute assembly 18 are incorporated into a modular assembly 45, preferably secured in offset relationship at a lower frontal corner on side wall 22 of container 11. The assembly includes a tubular shroud 46 that covers the distal end of screw conveyor 14. As shown, a circular opening 47 formed through side wall 22 to accommodate the screw conveyor and a flange 48 of the assembly is detachably secured on the side wall by four screws 49.

As further shown in FIGS. 1–3, hand crank 13 is secured on an end of screw conveyor shaft 26. Measuring tape 16 is inserted downwardly into a vertically disposed dovetail slot or groove, formed on a frontal side of measuring cup 15. The tape has graduated indicia imprinted thereon to permit the customer to visually note when the desired quantity of product is contained in the transparent measuring cup. The indicia may indicate either volume or weight, depending on the particular food product being dispensed.

Tray and chute assembly 18 has its rearward end pivotally mounted on cup 15 by a pair of laterally spaced and aligned pins or screws 55. As shown in FIGS. 2 and 3, assembly 18 is adapted to pivot from its solid line closed position 18, covering the open bottom of measuring cup 15, to its phantom line dispensing position 18'. A tension coil or retraction spring 56 has its upper end attahed to a first pin 57 secured on an upper end of a backside of cup 15 and its lower end attached to a second pin 58 secured on a backside of tray and chute assembly 18.

As further shown in FIG. 2, pin 58 is offset rightwardly, relative to pin 57, whereby movement of tray and chute assembly 18 to its phantom line open or dispensing position 18' will permit the spring to retract when the assembly is released. Thus, the spring will automatically bias and move the assembly back to its solid line closed position 18, covering the open bottom of cup 15. Alternatively, one or more torsion springs could be suitably mounted between tray and chute assembly 18 and cup 15 to bias the assembly towards its closed position.

Another novel aspect of this invention resides in the construction and arrangement of tray and chute assembly 18. The assembly comprises a bottom wall 60 that normally underlies and covers the open bottom end of cup 15 and a pair of laterally spaced side walls 61 extending upwardly from the bottom wall to straddle the lower end of the cup. An upper wall 62 is secured between upper ends of the side walls and positioned exteriorly of the cup to define a tubular dispensing chute, terminating at an outlet 63. Thus, when a customer desires to empty the measured quantity of product contained in cup 15, he need only place the open end of a bag over open end 63 of tray and chute assembly 18 and pivot the assembly to its phantom-line open position 18' in FIG. 2.

Another novel aspect of this invention is the addition of a baffle 64 to the chamber of dispenser 10 to aid in the dispensing function. A flat upper end 65 of the baffle is loosely hung on the inner side of front wall 20 by a pair of spaced screws 66, each threadably mounted in one of three vertically aligned and threaded holes 67. The baffle extends substantially the full width of front wall 20, as shown in FIGS. 1 and 2.

A keyhole type opening 68 is formed through the baffle to facilitate mounting of the baffle over a head of each screw 66. Adequate clearance is provided between the head and the shank of each screw, disposed in a respective opening 68, and the baffle to permit the baffle to "shake" for purposes described hereinafter.

The baffle has a flat lower end 69 that extends inwardly and downwardly over screw conveyor 14 and towards bottom wall 24 to define a separation space or gate 70 therebetween. The size of the gate will control product flow to conveyor 14 and the size of the product enabled to be dispensed. A boss 71 is secured interiorly of baffle 64 to facilitate manual removal of the baffle and threaded attachment of screws in a selected hole 67 to adjust the size of gate 70, e.g., the gate is shown at its maximum size in FIG. 3.

FIG. 4 illustrates actuating means 72 for reciprocating or shaking baffle 64 generally vertically in response to rotation of screw conveyor 14. The actuating means comprises a plate cam 73 secured on shaft 26 and a cam follower, shown in the form of a set screw 74 threaded to the baffle to have its head engage the cam. When the baffle is mounted in its desired vertical position to set the size of gate 70, set screw 74 is turned to engage its head with the cam. Thus, clockwise rotation of the cam in FIG. 14 will function to shake the baffle which is loosely hung on front wall 20 of the container.

We claim:

1. A sanitary foodstuff dispenser for dispensing a measured quantity of solid foodstuff comprising upstanding front, back and side walls and a bottom wall secured in said container to slope downwardly from said back wall toward said front wall, a closed container defining a chamber adapted to be at least partially filled with a preselected quantity of solid foodstuff, a measuring cup means mounted on said container for receiving said measured quantity of said foodstuff, screw means exposed to the foodstuff in said chamber for selectively filling said cup means with said measured quantity of foodstuff in response to rotation of said screw means, said screw means positioned closely adjacent to a juncture of said front wall and said bottom wall, dispensing means for dispensing said measured quantity of foodstuff from said cup means, baffle means movably mounted in said chamber, said baffle means comprising a baffle mounted on said front wall and sloping downwardly and away from said front wall and towards said bottom wall to terminate at an edge defined on a lower end thereof spaced from said bottom wall to define an unobstructed gate controlling the quantity of foodstuff to said screw means, and actuating means secured on and responsive to rotation of said screw means for shaking said baffle means and said foodstuff.

2. The dispenser of claim 1 wherein an upper end of said baffle is loosely mounted on said front wall by fastening means for permitting said baffle to reciprocate generally vertically in response to rotation of said screw means.

3. The dispenser of claim 1 further comprising means for vertically adjusting the position of the upper end of said baffle on said front wall.

4. The dispenser of claim 1 wherein said actuating means comprises a cam secured on a distal end of said screw means adjacent to a sidewall of said dispenser remote from said cup means and engaging the lower end of said baffle.

5. The dispenser of claim 4 wherein said baffle means further comprises a set screw adjustable mounted on the lower end of said baffle and engaging said cam.

6. The dispenser of claim 1 wherein said cup means comprises a transparent cup secured on said container and defining an open upper end communicating with said screw means and an open bottom end and wherein said dispensing means comprises a tray and chute assembly having its rearward end pivotally mounted on said cup for movement from a first position normally closing the open bottom of said cup to a second position opening the open bottom of said cup to dispense said measured quantity of foodstuff therefrom, said tray and chute assembly comprising a bottom wall normally covering the open bottom end of said cup, a pair of laterally spaced side walls extending upwardly from said bottom wall to straddle a lower end of said cup and an upper wall secured between upper ends of said sidewalls and positioned exteriorly of said cup to define a tubular dispensing chute for foodstuff discharged from said cup when said tray and chute assembly is moved to its second position.

7. The dispenser of claim 6 further comprising spring means for pivoting said tray and chute assembly towards its first position.

8. The dispenser of claim 1 wherein said screw means comprises a shaft having a plurality of partially circular flat blades secured in longitudinally spaced relationship thereon with each of said blades being disposed at an acute angle relative to a longitudinal and rotational axis of said screw means, each of said blades comprising a plurality of flexible fingers.

9. The dispenser of claim 8, wherein said fingers extend outwardly from said shaft in parallel relationship relative to each other.

* * * * *